US005730432A

United States Patent [19]

Gendreau et al.

[11] Patent Number: 5,730,432

[45] Date of Patent: Mar. 24, 1998

[54] MULTI-BEAM STRONGBACK CLAMP

[76] Inventors: Brent Gendreau, 996 Glen Oaks La., Glenwood Springs, Colo. 81601; Robert Porter, 275 Mesa Dr. Citizenship, Rifle, Colo. 81650

[21] Appl. No.: 689,673

[22] Filed: Aug. 13, 1996

[51] Int. Cl.[6] ..... B25B 1/20

[52] U.S. Cl. ..... 269/41; 269/217; 269/234

[58] Field of Search ..... 269/41, 42, 217, 269/234

[56] References Cited

U.S. PATENT DOCUMENTS 2,680,459 6/1954 Dodson et al. ..... 269/41

3,357,464 12/1967 Vroman ..... 269/41

4,475,726 10/1984 Smith .

4,795,141 1/1989 Mulvaney .

4,986,043 1/1991 Love .

5,364,084 11/1994 Karash .

*Primary Examiner*—Robert C. Watson

*Attorney, Agent, or Firm*—Patent & Trademark Services; Joseph H. McGlynn

[57] ABSTRACT

A clamp used in the concrete forming industry to attach various devices to framing systems in order to maintain vertical alignment of concrete forms. The clamp is a wedge style clamp that provides a friction connection between the waler and strongback beam. The clamp is set in place by use of a hammer and is a one piece design so the various parts will not be lost.

5 Claims, 1 Drawing Sheet

MULTI-BEAM STRONGBACK CLAMP

BACKGROUND OF THE INVENTION

This invention relates, in general, to clamps, and, in particular, to a clamp used in concrete forming systems to maintain vertical alignment of concrete forms.

DESCRIPTION OF THE PRIOR ART

In the prior art various types of clamps for positioning work pieces have been proposed. For example, U.S. Pat. No. 4,475,726 discloses a clamp which holds at least two work pieces. The clamp has a main support slidably connected to a first work piece, and a housing affixed to a main support. The housing assembly includes two side plates, a cam with a handle rotatably attached to the side pieces and a ratchet to lock the cam into a fixed position.

U. S. Pat. No. 4,795,141 discloses a cam locked stud nailing fixture which includes a fixture base with a web having depending side plates and a pair of abutment flanges upstanding from the web. A cylindrical cam is positioned on the side plates and the opposite side plate has a plurality of gripping spikes.

U.S. Pat. No. 4,986,043 discloses a device for holding a was frame unit into an erect an plumb position including a pulling unit mounted on one wail unit and a pulled unit mounted on the other wall unit. A cable connects the two units together via a lock handle on the puller unit.

U.S. Pat. No. 5,190,270 discloses a rebar clamp for clamping rebars to templates during the pouring of footings. The clamp includes a body formed as a helical coil and having a transverse handle. A pair of arms are placed to embrace a template and the arms have a hook which engages a rebar to clamp the rebar against the template.

The present types of clamps used in the concrete industry commonly use ½ inch coil rods and nuts, several pieces of specially cut 2×4's, that are nailed together, and the use of a crescent wrench in order to secure the specially cut 2×4's together to form a concrete frame. This type of connection is complicated and time consuming to construct, and care must be taken to assure accuracy of the form. What is needed is a means of assembling concrete forms that is quick and accurate.

SUMMARY OF THE INVENTION

The present invention comprises a clamp used in the concrete industry to attach various devices to forming systems in order to maintain vertical alignment of concrete forms. The clamp is a wedge style clamp that provides a friction connection between the waler and strongback beam. The clamp is set in place by use of a hammer and is a one piece design so the various parts will not be lost.

It is an object of the present invention to provide a new and improved clamp used to maintain vertical alignment of concrete forms in a safe and efficient manner.

It is an object of the present invention to provide a new and improved clamp used to maintain vertical alignment of concrete forms in which the clamp is one piece to avoid loss of parts.

It is an object of the present invention to provide a new and improved clamp used to maintain vertical alignment of concrete forms in which the clamp can be assembled to the forms with common tools.

These and other objects and advantages of the present invention will be fully apparent from the following description, when taken in connection with the annexed drawings.

DESCRIPTION OF THE PREFERRED EMBODIMENT

Figure 1:
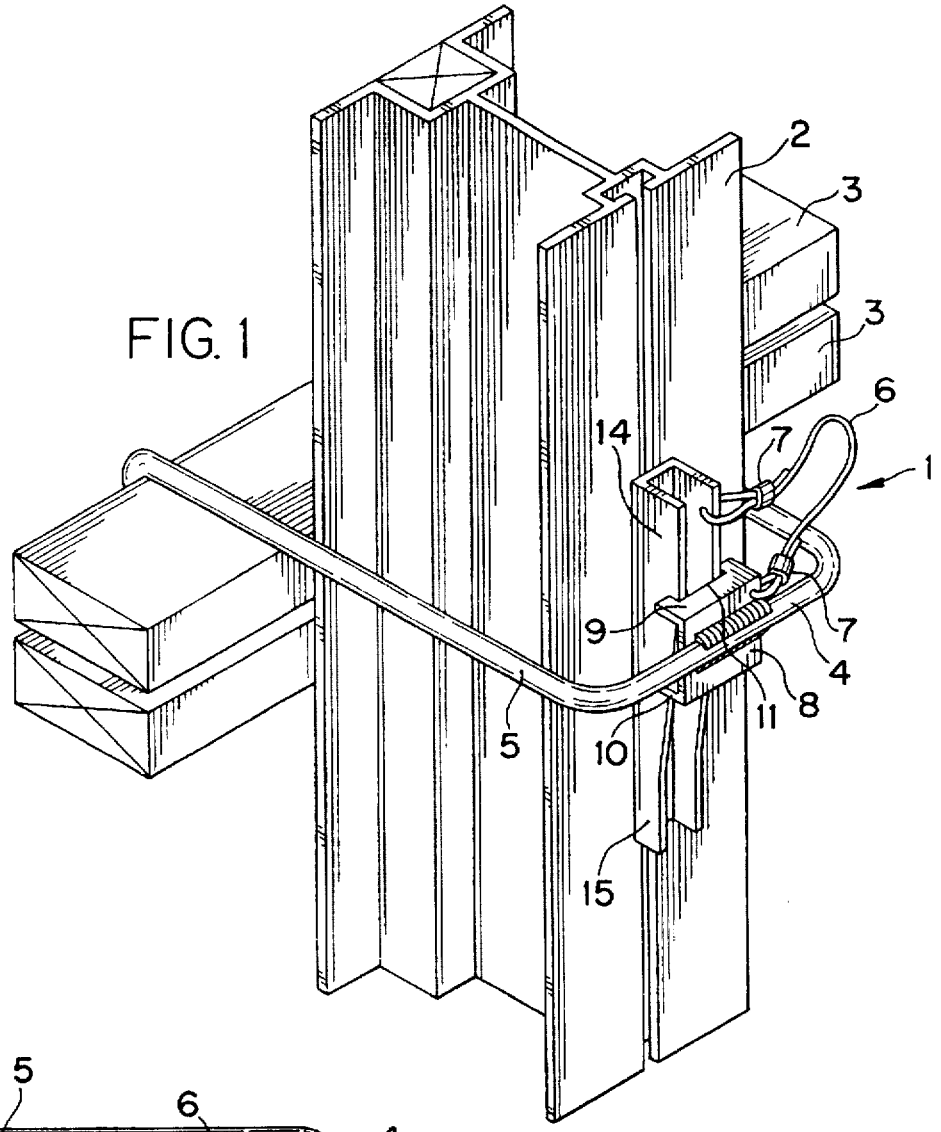
FIG. 1 is a perspective view showing the clamp of the present invention in place on a concrete form.
Figure 2:
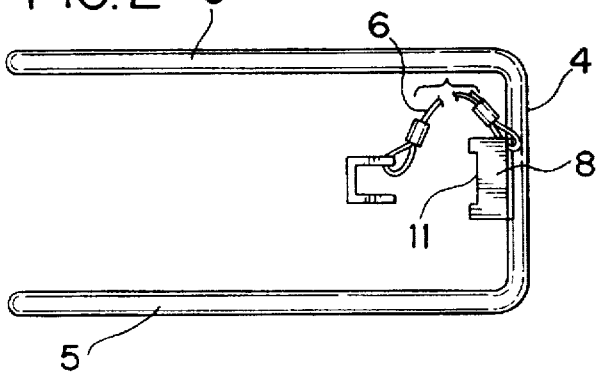
FIG. 2 is a top view of the clamp of the present invention.

Referring now to the drawings in greater detail, FIG. 1 shows the clamp 1 in position on the waler of a concrete forming system. In the example shown in FIG. 1, an I-beam 2 (referred to as a "strongback beam") is positioned in a vertical orientation with respect to a pair of horizontal wood beams 3, 3 (referred to as a "waler"). However these are used merely for illustration purposes and the I-beam and/or waler can be made of any suitable type of material.

The clamp 1 comprises a pair of arms 5 which are joined at one end by a cross member 4 to form a substantially U-shape. Positioned within the U-shape is a channel or U-shaped wedge member having an upper portion 14 and a lower portion 15, for a purpose to be explained below. Directly adjacent the wedge member is a second U-shaped member comprising a cross member 8, which is joined to two arms 9, 10. Member 8 is joined to cross member 4 by two ¼ inch welds 16. The wedge member 14, 15 and the second U-shaped member 8 are joined by a lanyard 6 which is permanently connected to the wedge member and the second U-shaped member by crimped connectors 7. The crimped members 7 are merely examples of the type of connector that can be used to secure the lanyard 7, and should not be considered the only type of connection that will or could be used. As long as the connection between the lanyard, the wedge member and the second U-shaped member is a permanent one, the specific type of connector used is not material to the present invention.

Figure 3:
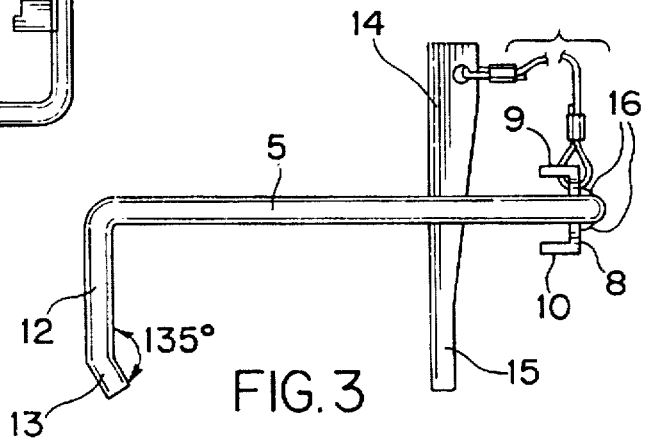
FIG. 3 is a side view of the clamp of the present invention.

As shown in FIG. 3, each of the arms 5 of the clamp have a downwardly projecting arm 12, which ends in a flange portion 13. The flange portions 13 are connected to the arms 12 by an angle of approximately 35°.

In use, the vertical or strongback beam 2 will be placed in position and plumbed while the clamp arms 4,5 are passed around the strongback beam 2. Next, the arms 12 and 13 are positioned around the waler 3. With the parts in this position, the wedge 14, 15 will be inserted into the groove 11 in the second U-shaped member and hammered down until the strongback beam 2 is securely fastened to the waler 3.

Although the Multi-Beam Strongback Friction Clamp and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fail within the claimed scope of this invention.

What I claim as my invention is:

1. A system for maintaining the vertical alignment of concrete forms, said concrete forms comprising at least one vertical member and at least one horizontal member, said system comprising:

a first clamp means for supporting said at least one vertical member and at least one horizontal member, said clamp means having means on one end for attachment to said at least one vertical member and means on another end for attachment to said at least one horizontal member, second clamp means positioned between said first clamp means and said at least one vertical member, wedge means positioned between said second clamp means and said at least one vertical member, and wherein said first clamp means is a substantially U-shaped member comprising a bottom member joined to a pair of arms, each of said arms having another arm attached thereto and extending from said arms at approximately a 90° angle, each of said another arms having a third arm attached thereto and extending from said another arm at an angle greater than 90°, whereby when said wedge means is fully positioned between said second clamp means and said at least one vertical member, said at least one vertical member and at least one one horizontal member will be securely fastened together.

2. The system for maintaining the vertical alignment of concrete forms as claimed in claim 1, wherein said angle greater than 90° is 135°.

3. The system for maintaining the vertical alignment of concrete forms as claimed in claim 1, wherein said second champ means, positioned between said first clamp means and said at least one vertical member, is a U-shaped member comprising a bottom and two arms, said bottom having projection means positioned thereon for receiving said bottom member of said first clamp means.

4. The system for maintaining the vertical alignment of concrete forms as claimed in claim 3, wherein said two arms of said U-shaped member each have a slot means for receiving said wedge means.

5. The system for maintaining the vertical alignment of concrete forms as claimed in claim 1, wherein said second clamp means and said wedge means are connected together by a lanyard.

* * * * *